US007911442B2

(12) United States Patent
Wang et al.

(10) Patent No.: US 7,911,442 B2
(45) Date of Patent: Mar. 22, 2011

(54) DYNAMIC COLOR GAMUT OF LED BACKLIGHT

(75) Inventors: Te-Mei Wang, Hsin-Chu (TW); Chih-Kuang Chen, Hsin-Chu (TW); Shen-Hong Chou, Hsin-Chu (TW); Hsin-Wu Lin, Hsin-Chu (TW)

(73) Assignee: AU Optronics Corporation, Hsinchu (TW)

( * ) Notice: Subject to any disclaimer, the term of this patent is extended or adjusted under 35 U.S.C. 154(b) by 812 days.

(21) Appl. No.: 11/845,419

(22) Filed: Aug. 27, 2007

(65) Prior Publication Data

US 2009/0058876 A1 Mar. 5, 2009

(51) Int. Cl.
*G09G 3/36* (2006.01)

(52) U.S. Cl. ..... 345/102; 345/87; 345/690; 345/100

(58) Field of Classification Search ..... 345/102, 345/690, 204, 211–213, 589, 590
See application file for complete search history.

(56) References Cited

U.S. PATENT DOCUMENTS 6,213,615 B1 4/2001 Siitari
6,388,648 B1 5/2002 Clifton et al.
6,816,141 B1 11/2004 Fergason
6,891,672 B2 5/2005 Whitehead et al.
2005/0231457 A1* 10/2005 Yamamoto et al. ..... 345/102
2005/0248593 A1* 11/2005 Feng et al. ..... 345/690

FOREIGN PATENT DOCUMENTS

CN 1932615 A 3/2007
JP 2007116593 A 5/2007

* cited by examiner

*Primary Examiner* — Duc Q Dinh
(74) *Attorney, Agent, or Firm* — Tim Tingkang Xia; Morris, Manning & Martin, LLP

(57) ABSTRACT

A backlight unit usable in an LCD for dynamically expanding color gamut of the LCD. In one embodiment, the backlight unit has a plurality of light emitting elements, and a control unit electrically coupled with the plurality of light emitting elements for controlling intensity of light emitting from each of the plurality of light emitting elements in response to a frame of image data applied to the plurality of pixels, wherein the control unit is configured such that when the frame of image data applied to the plurality of pixels is in a red color, a green color, or a blue color, the intensity of light from the red color, the green color, or the blue color emitting from each of the plurality of light emitting elements is adjusted to its corresponding maximal value so as to expand the red, the green, or the blue area of the color gamut of the LCD panel accordingly.

35 Claims, 9 Drawing Sheets

(A)

(B)

(B)

(A)

DYNAMIC COLOR GAMUT OF LED BACKLIGHT

CROSS-REFERENCE TO RELATED PATENT APPLICATION

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

FIELD OF THE INVENTION

The present invention relates generally to a liquid crystal display (LCD), and more particularly, to a backlight unit usable in an LCD for dynamically expanding the color gamut of the LCD.

BACKGROUND OF THE INVENTION

Liquid crystal display (LCD) is commonly used as a display device because of its capability of displaying images with good quality while using little power. An LCD apparatus includes an LCD panel formed with liquid crystal cells and pixel elements with each associating with a corresponding liquid crystal cell and having a liquid crystal capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals are sequentially applied to the number of pixel rows for sequentially turning on the pixel elements row-by-row. When a scanning signal is applied to a pixel row to turn on corresponding TFTs of the pixel elements of a pixel row, source signals (image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

An LCD is a passive display device and usually requires a cold cathode fluorescent lamp to provide backlight to display an image on the LCD screen. A constant brightness backlight is usually provided by a backlight module. Therefore, the contrast ratio of the LCD display is determined by the transmittance of the LCD. Generally, the backlight module is electrically coupled with an input color image signal and the brightness of the backlight module is adjusted according to the input color image signal to be displayed on the LCD screen. The contrast of the LCD display is therefore increased.

For example, as shown in FIG. 8, an optical display system was disclosed by Gergason et al. in U.S. Pat. No. 6,816,141. The display apparatus includes a passive display, a light source, and a video signal input. A method of producing a displayed image was also disclosed by using a passive display illuminated by a light source is characterized in controlling the light source to obtain a displayed image with a desired amount of information, grayscale and/or color characteristics. The light source modulates the light as a function of some type of controlled input, such as a video signal. The transmittance of the LCD cell and the intensity of the backlight are both controlled by the input image signal, resulting an increased contrast of the displayed images.

In recent years, light emitting diode (LED) array modules have emerged as a new backlight source and become increasingly popular because they can provide more vivid and brighter color images. When a red-green-blue (RGB) tri-color LED is used for backlight, the current through these RGB tri-color diodes needs to be adjusted so that the backlight LED module provides a balanced white color backlight. Since the RGB LED intensity may vary with the surrounding temperature from time to time, such variation should be detected and the intensity of the RGB LED should be compensated accordingly so as to keep the color temperature relatively constant.

In an example shown in FIG. 9, a method for adjusting the color temperature in an LCD with backlighting was disclosed by U.S. Pat. No. 6,213,615 to Siitari et al. The LCD is lit by two or more background light lamps (LAMP 1, 2, 3, 4, 5) with different color temperatures, the color temperature range of the backlight lamps (LAMP 1, 2, 3, 4, 5) is extended and better opportunities for adjusting the color temperature by changing the pass rate of the light are provided. In a more advanced solution, backlight lamps (LAMP 1, 2, 3, 4, 5) with different color temperatures are switched on switch SI separately for setting the color temperature of the display, and the brightness of the backlight lamps with different color temperatures can be adjusted separately for setting the color temperature.

However, such backlight devices consume large amount of electrical energy and produces large amount of heat during operation. On the other hand, the backlight of the backlight devices can not be individually adjusted according to a pixel level. Thus the color gamut is limited.

Therefore, a heretofore unaddressed need exists in the art to address the aforementioned deficiencies and inadequacies.

SUMMARY OF THE INVENTION

The present invention, in one aspect, relates to a backlight unit usable in an LCD for dynamically expanding the color gamut of the LCD. The LCD has an LCD panel having a plurality of pixels spatially arranged in a matrix for displaying an image.

In one embodiment, the backlight unit has a plurality of light emitting elements, and a control unit. Each of the plurality of light emitting elements is capable of emitting light in a red color, a green color and a blue color individually and/or collectively and arranged for illuminating a corresponding area of the LCD panel having at least one pixel. The emitted light in a color is characterized with an intensity between a maximal value and a minimal value that is less than the maximal value.

The control unit is electrically coupled with the plurality of light emitting elements and configured for controlling the intensity of light emitting from each of the plurality of light emitting elements in response to a frame of image data applied to the plurality of pixels. In one embodiment, the control unit is configured such that when the frame of image data applied to the plurality of pixels is in a red color, the intensity of light in the red color emitting from each of the plurality of light emitting elements is adjusted to its corresponding maximal value so as to expand the red area of the color gamut of the LCD panel, when the frame of image data applied to the plurality of pixels is in a green color, the intensity of light in the green color emitting from each of the plurality of light emitting elements is adjusted to its corresponding maximal value so as to expand the green area of the color gamut of the LCD panel, and when the frame of image data applied to the plurality of pixels is in a blue color, the intensity of light in the blue color emitting from each of the plurality of light emitting elements is adjusted to its corresponding maximal value so as to expand the blue area of the color gamut of the LCD panel.

In one embodiment, the control unit is further configured such that when the frame of image data applied to the plurality of pixels is in the red color, the intensities of light in the green and blue colors emitting from each of the plurality of light emitting elements are adjusted to their corresponding minimal value, respectively, when the frame of image data applied to the plurality of pixels is in the green color, the intensities of light in the red and blue colors emitting from each of the plurality of light emitting elements are adjusted to their corresponding minimal value, respectively, and when the frame of image data applied to the plurality of pixels is in the blue color, the intensities of light in the red and green colors emitting from each of the plurality of light emitting elements are adjusted to their corresponding minimal value, respectively.

In one embodiment, the control unit includes a circuit controlling the at least one light emitting element individually of each of the plurality of regions. In another embodiment, the control unit includes a circuit controlling each of the plurality of light emitting elements individually. In yet another embodiment, the control unit includes a circuit controlling each LED of each light emitting element individually. The intensity of light emitting from each LED of each light emitting element is adjustable between its minimal value and its maximal value discretely and/or continuously.

Additionally, the backlight unit also includes a panel for housing the plurality of light emitting elements, where the plurality of light emitting elements is spatially arranged in a matrix. The LCD panel is dividable into a plurality of regions. Each of the plurality of regions has at least one light emitting element. In one embodiment, each of the plurality of light emitting elements has at least three light emitting diode (LED) chips, each of the at least three LED chips being capable of emitting light in a corresponding color of at least a red color, a green color, and a blue color. In another embodiment, each of the plurality of light emitting elements has an LED capable of emitting light in one or more colors.

In another aspect, the present invention relates to a backlight unit usable in an LCD for dynamically expanding the color gamut of the LCD. The LCD has an LCD panel having a plurality of pixels spatially arranged in a matrix for displaying an image signal and a signal processing unite for processing the image signal into a set of data signals according to the plurality of pixels of the LCD panel, where each data signal is characterized at least with a color. In one embodiment, the backlight unit has a source of light capable of emitting light of different colors, and a control unit. The source of light has a plurality of light emitting elements. Each of the plurality of light emitting elements is arranged for illuminating a corresponding area of the LCD panel with at least one pixel. The emitted light of different colors is characterized by intensity between a maximal value and a minimal value that is less than the maximal value. The control unit is electrically coupled with the source of light and configured for individually controlling the intensities of light of different colors emitting from the source of light in response to the set of data signals applied to the plurality of pixels such that when an area of the LCD panel is applied with a corresponding data signal, the light emitting element associated with the area of the LCD panel emits light with the maximal intensity in a color corresponding to the color associated with the corresponding data signal.

The backlight unit further has a panel for housing the plurality of light emitting elements. The plurality of light emitting elements is spatially arranged in a matrix. The panel is dividable into a plurality of regions. Each of the plurality of regions has at least one light emitting element. In one embodiment, each of the plurality of light emitting elements has at least three LED chips. Each of the at least three LED chips is capable of emitting light in a corresponding color of at least a red color, a green color, and a blue color. In another embodiment, each of the plurality of light emitting elements has an LED capable of emitting light in one or more colors.

In one embodiment, the signal processing unit is configured to perform the functions of: receiving the image signal I from a video source; calculating RGB elements of the image signal I to determine a dominant color in each backlight illuminating area; transforming the RGB elements into a multi-color video signal; downsampling the multi-color video signal to form a downsampled image signal that has a resolution corresponding to that of the backlight unit; converting the downsampled image signal into a backlight signal $I_0$; and presenting the backlight signal $I_0$ to the control unit of the backlight unit.

The signal processing unit is configured to further perform the functions of: convoluting the backlight signal $I_0$ from with a light spread function (LSF) P to form a convoluted signal $P \otimes I$; dividing the image signal I by the convoluted signal $P \otimes I$ to obtain the set of RGB elements; applying gamma correction to the set of RGB elements; and transforming the set of RGB elements to a set of data signal for image display in the LCD panel.

In yet another aspect, the present invention relates to a method for dynamically expanding the color gamut of an LCD. The LCD has an LCD panel having a plurality of pixels spatially arranged in a matrix for displaying an image. The image is processed into a set of data signals according to the plurality of pixels of the LCD panel. Each data signal is characterized at least with a color. In one embodiment, the method includes the steps of: (i) providing a backlight unit positioned in relation to the LCD panel, (ii) applying the set of data signals to the plurality of pixels, and (iii) individually controlling the intensities of light of different colors emitting from the source of light in response to the set of data signals applied to the plurality of pixels such that when an area of the LCD panel is applied with a corresponding data signal, the light emitting element associated with the area of the LCD panel emits light with the maximal intensity in a color corresponding to the color associated with the corresponding data signal.

The backlight includes a source of light capable of emitting light of different colors. The source of light has a plurality of light emitting elements. Each of the plurality of light emitting elements is associated with a corresponding area of the LCD panel having at least one pixel. The emitted light of different colors is characterized with an intensity between a maximal value and a minimal value that is less than the maximal value. In one embodiment, the method further includes the step of directing light emitting from the source of light to the LCD panel.

In one embodiment, each of the plurality of light emitting elements has an LED capable of emitting light in one or more colors. In another embodiment, each of the plurality of light emitting elements has at least three LED chips, each of the at least three LED chips being capable of emitting light in a corresponding color of at least a red color, a green color, and a blue color. The intensity of light emitting from each LED of each light emitting element is adjustable between its minimal value and its maximal value discretely and/or continuously.

In a further aspect, the present invention relates to a method for dynamically expanding the color gamut of an LCD. The LCD has an LCD panel having a plurality of pixels spatially arranged in a matrix for displaying an image. The image is processed into a set of data signals according to the plurality of pixels of the LCD panel, and each data signal is characterized at least with a color. In one embodiment, the method includes the steps of: providing a source of light capable of emitting light of different colors for illuminating the LCD panel responsively, and individually controlling the intensities of light of different colors emitting from the source of light in response to the set of data signals applied to the plurality of pixels. The emitted light of different colors is characterized with an intensity between a maximal value and a minimal value that is less than the maximal value. In one embodiment, the method further includes the step of applying the set of data signals to the plurality of pixels. In another embodiment, the method further includes the step of directing light emitting from the source of light to the LCD panel.

In one embodiment, the source of light has a plurality of light emitting elements. Each of the plurality of light emitting elements is capable of emitting light in one or more colors and is associated with a corresponding area of the LCD panel having at least one pixel. In one embodiment, the controlling step includes the step of controlling a light emitting element associated with an area of the LCD panel to emit light with the maximal intensity in a color corresponding to the color associated with a corresponding data signal applied to the area of the LCD panel. In one embodiment, each of the plurality of light emitting elements has an LED capable of emitting light in one or more colors. In another embodiment, each of the plurality of light emitting elements has at least three LED chips, each of the at least three LED chips being capable of emitting light in a corresponding color of at least a red color, a green color, and a blue color.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
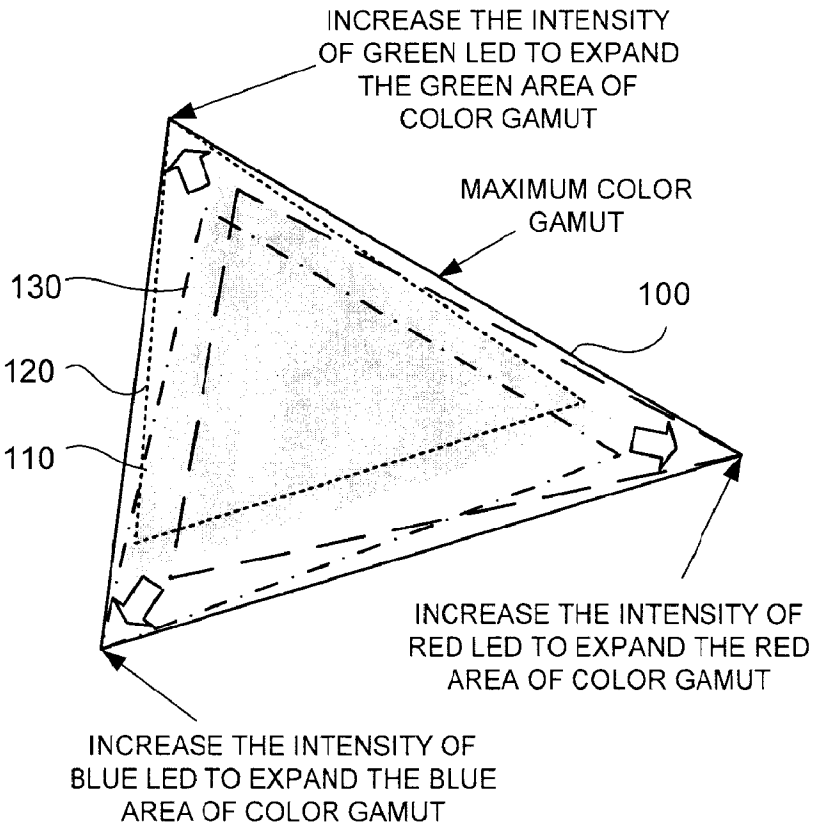
FIG. 1 shows schematically (A) an xy chromaticity diagram of CIE 1931, and (B) a dynamic expansion of a color gamut of an LCD according to one embodiment of the present invention.
Figure 1:
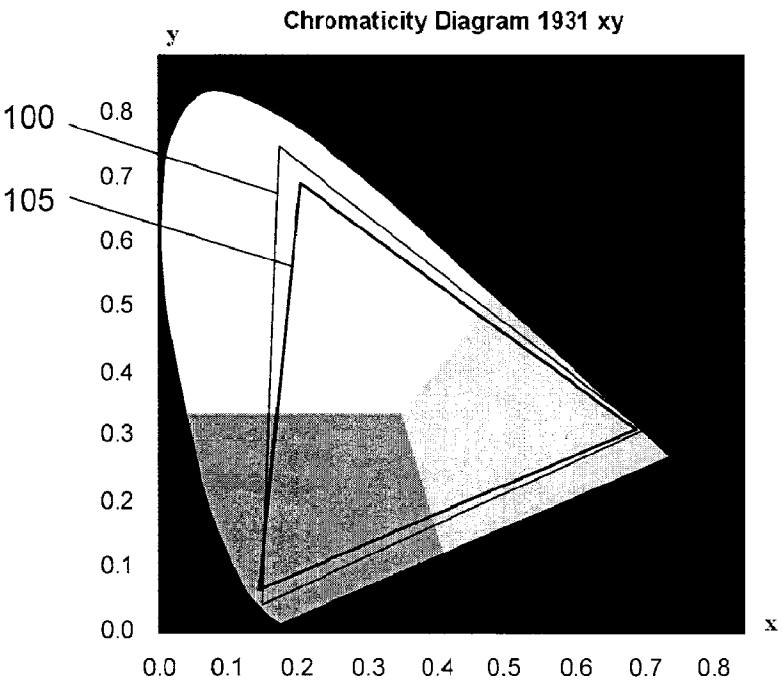

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. The terms "LCD", "LCD screen", "LCD display" and "LCD panel" are interchangeable.

As used herein, the terms "gamma" and/or "gamma curve" refer to the characteristics of brightness of an imaging display system, for example, an LCD device, versus grayscales (scales). Gamma summarizes, in a single numerical parameter, the nonlinear relationship between grayscale and brightness of the imaging display system.

As used herein, the terms "grayscale" and "gray level" are synonym in the specification and refer to one of (discrete) shades of gray for an image, or an amount of light perceived by a human for the image. If the brightness of the image is expressed in the form of shades of gray in n bits, n being a positive integer, the grayscale takes values from zero representing black, up to $(2^n-1)$ representing white, with intermediate values representing increasingly light shades of grey. In an LCD device, the amount of light that transmits through liquid crystals is adjusted to represent the grayscale.

As used herein, the term "grayscale voltage" or "driving voltage" refers to a voltage generated from a data driver in accordance for driving a particular area or pixel of an LCD panel, in accordance with a grayscale of a frame of an image to be displayed at the particular area or pixel of the LCD panel.

The terms "light transmittance/transmission", "brightness" and "luminance", as used herein, are synonym in the specification and refer to the amount of light that passes through a particular area of an LCD panel.

DEFINITIONS/GLOSSARY

ASIC: application-specific integrated circuit, is an integrated circuit (IC) customized for a particular use, rather than intended for general-purpose use.

BL: backlight, the form of illumination used in an LCD display.

DVI: Digital Visual Interface.

FPGA: field programmable gate array, a semiconductor device containing programmable logic components and programmable interconnects.

NTSC: National Television System Committee, an analog television system used in Canada, Japan, South Korea, the Philippines, the United States, and some other countries, mostly in the Americas.

LCD: liquid crystal display.

LVDS: low voltage differential signaling.

LSF: light spread function, a function that represents light distribution of one backlight unit or region.

RGB: three primary colors: red, green and blue.

Rx: receiver, receiving.

Tx: transmitter, transmission.

OVERVIEW OF THE INVENTION

The description will be made as to the embodiments of the present invention in conjunction with the accompanying drawings in FIGS. 1-7. In accordance with the purposes of this invention, as embodied and broadly described herein, this invention, in one aspect, relates to a backlight unit usable in an LCD for dynamically expanding the color gamut of the LCD. The LCD has an LCD panel comprising a plurality of pixels spatially arranged in a matrix for displaying an image.

In computer graphics, the gamut, or color gamut, is a certain complete subset of colors. The most common usage refers to the subset of colors which can be accurately represented in a given circumstance, such as within a given color space or by a certain output device. In color theory, the gamut of a device or process is that portion of the visible color space that can be represented, detected, or reproduced. Generally, the color gamut is specified in the hue-saturation plane, as many systems can produce colors with a wide range intensity within their color gamut. While processing a digital image, the most convenient color model used is the Red, Green, and Blue (RGB) model.

An xy chromaticity diagram of CIE 1931 is illustrated in FIG. 1(A). The grayed-out horseshoe shape is the entire range of possible colors. The triangles 100 and 105 shown in FIG. 1(A) are the gamut available to a typical graphical display such as an LCD screen, under different conditions. It does not cover the entire color space. The corners of the triangle are the primaries for this gamut: the green color on the top, the red color at the right lower corner, and the blue color at the left lower corner. In order to increase the color gamut of an LCD display, the key is to increase the color gamut of the backlight for the LCD display. One of the principles of the present invention is to dynamically increase the color gamut of the LED backlight based on the color of the region where the LED is providing backlight, so that the color gamut of the LED is increased, and the color gamut of the LCD display is also increased.

FIG. 1(A) shows an exemplary color gamut of two LED backlights to illustrate the enlarged color gamut according to one embodiment of the present invention. In FIG. 1(A), the triangle 105 represents the color gamut of a color backlight adjusted at a color temperature such as 10000 K. At this color temperature, the color gamut of this display is at a level of NTSC 103.3%. According to one embodiment of the present invention, the red LED of the backlight is adjusted to its maximum intensity when a red image is displayed in the region where the red LED is providing backlight. The green LED of the backlight is adjusted to its maximum intensity when a green image is displayed in the region where the green LED is providing backlight. The blue LED of the backlight is adjusted to its maximum intensity when a blue image is displayed in the region where the blue LED is providing backlight. The triangle 100 represents the color gamut of a color backlight adjusted to yield the maximum gamut. In this embodiment, the color gamut is dynamically increased to a level of NTSC 121%. The following table further compares the maximum brightness of the LED backlight at 10000 K color temperature condition and that at its maximum condition according to one embodiment of the present invention:

TABLE 1

Maximum Brightness Comparison

| Maximum Brightness (cd/m$^2$) | Red | Green | Blue | White |
|---|---|---|---|---|
| LED Backlight at 10,000K | 114.9 | 340.3 | 50.25 | 506.2 |
| LED backlight at Max RGB | 143.1 | 428.8 | 68.29 | 613.1 |

FIG. 1(B) illustrates an exemplary color gamut of an LCD and how the enlarged color gamut is achieved through increasing the intensity of three primary colors: red, green and blue, according to one embodiment of the present invention. Due to the limited brightness of a regular LED, either a white color LED or a color LED such as Red, Green or Blue, the LED backlight for an LCD screen is provided in small regions, with each region having a red LED, a green LED and a blue LED. Traditionally, the LED backlight uses white color LED to provide white color backlight. In order to increase the color gamut of the LCD, colored LEDs are used and individually control of intensity of the colored LEDs according to an image to be displayed is required. According to one embodiment of the present invention, the color images or colors video to be displayed are analyzed based on their brightness, hue and color saturation level, and a separate color control signal for each RGB color LED is obtained. The RGB LED intensity is individually controlled and/or adjusted so that the image color becomes more vivid, and more saturated. The backlight's RGB LEDs are configured to be turned on/off individually to further increase contrast of the image.

For example, if a portion of the image corresponding to a small region of the backlight is predominately red, that particular backlight region can turn the intensity of the red LED to maximum and turn off the green LED and the blue LED of the region. The triangle 110 moves horizontally towards the right of the triangle as indicated in FIG. 1(B), therefore, the red area of the color gamut is further expanded to the right. Similarly, if a portion of the image corresponding to a small region of the backlight is predominately green, that particular backlight region can turn the intensity of the green LED to maximum and turn off the red LED and the blue LED of the region. The triangle 120 moves vertically towards the top of the triangle as indicated in FIG. 1B, therefore, the green area of the color gamut is further expanded at the top. If a portion of the image corresponding to a small region of the backlight is predominately blue, that particular backlight region can turn the intensity of the blue LED to maximum and turn off the red LED and the green LED of the region. The triangle 130 moves horizontally towards the lower left corner as indicated in FIG. 1(B), therefore, the blue area of the color gamut is further expanded to the right. Since the red LED, the green LED and the blue LED are used in each backlight region, a combined color gamut triangle 100, the maximum color gamut, is achieved by using the combination of the red LED, the green LED and the blue LED in each backlight region.

Figure 2:
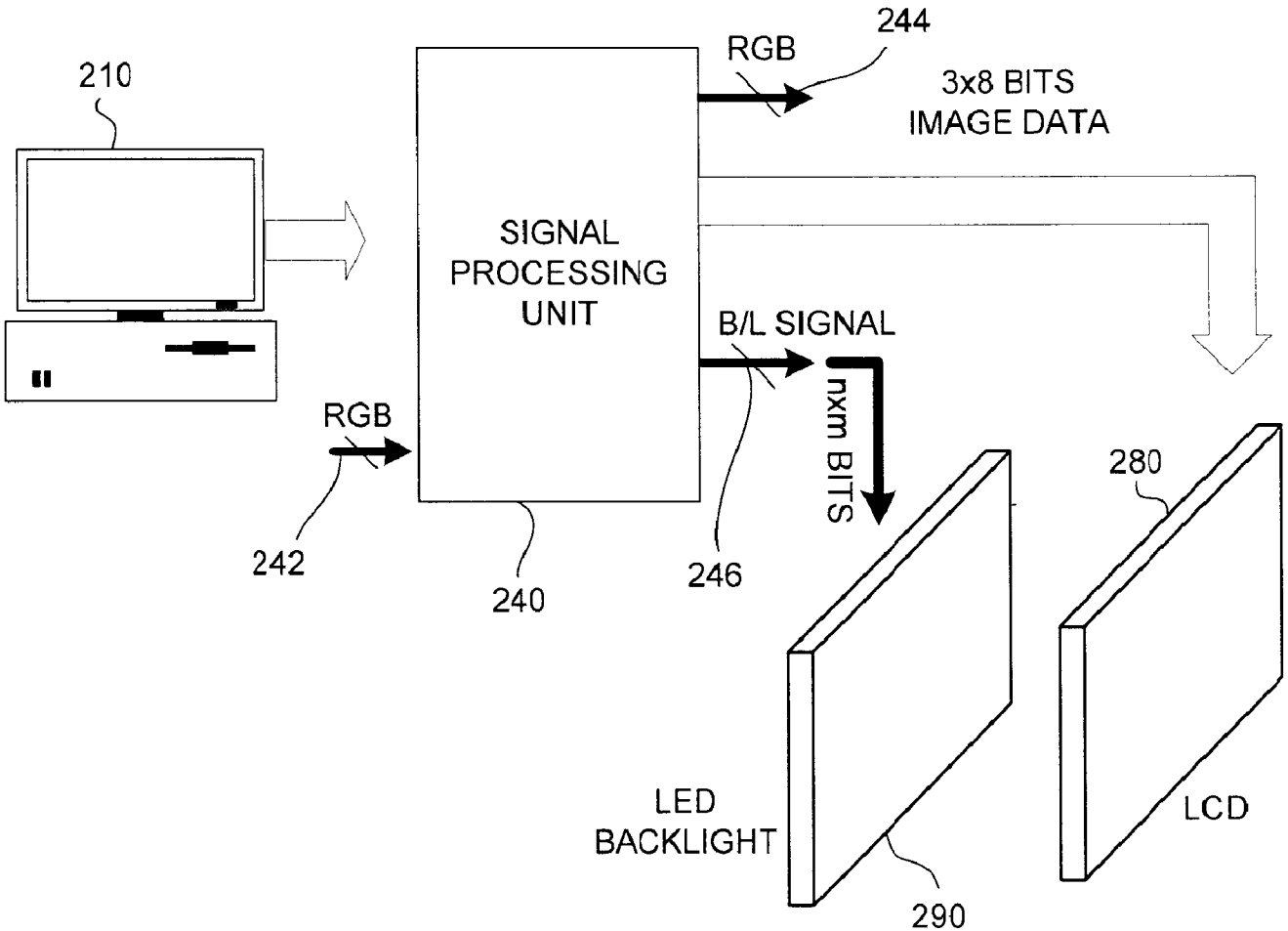
FIG. 2 shows a block diagram of an LCD having a dynamically expanded color gamut according to one embodiment of the present invention.

Referring now to FIG. 2, a block diagram of a dynamic color gamut of LED backlight system is displayed according to one embodiment of the present invention. The dynamic color gamut of LED backlight system has a video/image source 210, an input interface, a signal processing unit 240, an LCD display 280, and a backlight 290 for the LCD 280.

The input interface is adapted for receiving a digital input video signal from a digital video source 210 such as a computer, a DVD player, or a video camera etc. The digital input video signal represents a plurality of still color images or a digital video. The digital input video signal is a 24-bit digital image data, representing 16.7 million colors. It contains also bits representing pixels having different intensities of red color, green color, blue color (RGB), horizontal synchronization, vertical synchronization and digital clock elements. The digital input video signal is provided to the signal processing unit 240 for further processing. A field programmable gate array (FPGA) or an application-specific integrated circuit (ASIC) is used for the signal processing unit 240. Other options such as general purpose microprocessors, and specialized digital signal processors are also available.

The signal processing unit 240 is adapted for processing the digital input video signal to separate the digital input video signal into two sets of RGB elements: one set of RGB elements 244 for image display on the LCD screen, and one set of RGB elements 246 for the backlight 290 of the LCD screen 280. The signal processing unit 240 has a set of input RGB image data elements 242, a first output RGB elements 244 for image display on the LCD screen 280, and a second output RGB elements 246 for backlight of the LCD screen 280.

The processed digital input video signal of the first output RGB elements 244 for image display is transmitted to the LCD screen 280. One the other hand, the digital video signal of the second output RGB elements 246 for backlight of the LCD screen 280 is transmitted to the LED backlight 290. The second output RGB elements 246 for backlight of the LCD screen 280 contains n×m bits, where the n represents the number of color LEDs used in each backlight illuminating unit, and m represents the brightness of the image expressed in the form of shades of gray. In one embodiment, the number of color LEDs used in each backlight illuminating unit is 3, i.e., red, green and blue LEDs, and the brightness of the image expressed in the form of shades is 8 bits having a total of 256 different grayscales. In this example, the input RGB image data elements 242 and RGB elements 244 are 3×8 bits image data RGB. The brightness of the image expressed in the form of shades may be increased to 12 bits, having a total 4096 different grayscale.

The LED backlight panel 290 is adapted for receiving the second output RGB elements 246 to provide backlight to the LCD screen 280. The LCD screen 280 has an LCD panel having a plurality of pixels spatially arranged in a matrix for displaying an image. Due to the limited brightness of an individual LED or a tri-color combo LED, the LED backlight panel is made of multiple backlight illuminating regions, each of these regions provides a portion of the backlight for the LCD screen 280. On the other hand, in order to reduce cost of manufacturing such backlight illuminating regions, backlight illuminating regions may not be smaller than a pixel of an LCD. A compromise is to construct the LED backlight panel 290 with multiple backlight illuminating regions. These backlight illuminating regions are spatially arranged in the form of a matrix. The backlight illuminating regions {Rn,m}, n=1, 2, . . . , N, m=1, 2, . . . , M, where N is a positive integer and M is also a positive integer, form the LED backlight panel 290. Each of the backlight illuminating regions further has multiple backlight illuminating units {Up}, p=1, 2, . . . , P, where P is a positive integer. Each of the backlight illuminating units has a red LED {Rp}, a green LED {Gp}, and a blue LED {Bp}, respectively. These P backlight illuminating units cover one entire backlight illuminating region, and N×M backlight illuminating regions cover the entire LCD display area.

Figure 3:
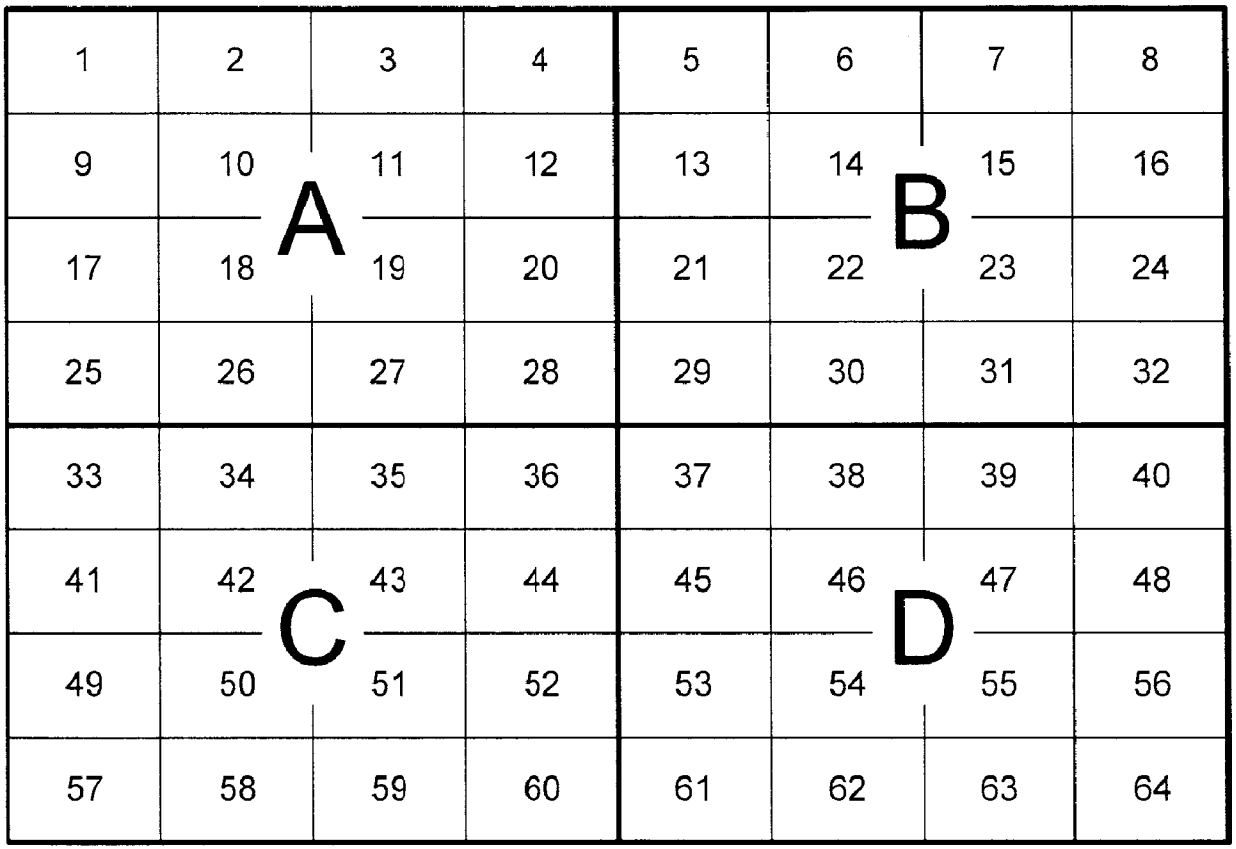
FIG. 3 shows schematically a panel having a plurality of backlight illuminating regions according to one embodiment of the present invention.

Referring now to FIG. 3, an exemplary LED backlight panel 290 is shown to provide backlight for an LCD according to the present invention. The backlight panel 290 has a plurality of light emitting elements. The backlight unit further includes a panel for housing the plurality of light emitting elements. The plurality of light emitting elements is spatially arranged in a matrix. In one embodiment, the light emitting element is an LED. In one embodiment, each of the plurality of light emitting elements is capable of emitting light in a red color, a green color and a blue color individually and/or collectively and is arranged for illuminating a corresponding area of the LCD panel having at least one pixel. The emitted light in a color characterized with an intensity between a maximal value and a minimal value that is less than the maximal value.

In this example, the entire LED backlight panel is divided into 64 backlight illuminating regions, where N=8, and M=8. Each of these 8×8=64 backlight illuminating regions has a number of backlight illuminating units (not shown). Each illuminating region has at least one light emitting element. Each of the light emitting element has at least three light emitting diode (LED) chips, where each of the at least three LED chips is capable of emitting light in a corresponding color of at least a red color, a green color, and a blue color. Other configurations having more or less major areas, backlight illuminating regions, backlight illuminating units, LEDs can also be utilized to practice the present invention.

Referring back to FIG. 2, an FPGA is used as the signal processing unit 240 in one embodiment. In another embodiment, an ASIC chip is used as the signal processing unit 240. General purpose microprocessors, and specialized digital signal processors are also available as alternatives for the signal processing unit 240.

The signal processing unit 240 has a set of input RGB elements 242, a first set of output RGB elements 244 for image display on the LCD screen 280, and a second set of output RGB elements 246 for the backlight 290 of the LCD screen 280. The signal processing unit 240 generally processes the digital input video signal and generates the two sets of output RGB elements. The signal processing unit 240 is electrically coupled with the plurality of light emitting elements for controlling the intensity of light emitting from each of the plurality of light emitting elements in response to a frame of image data applied to the plurality of pixels.

The signal processing unit 240 is configured such that (i) when the frame of image data applied to the plurality of pixels is in a red color, the intensity of light in the red color emitting from each of the plurality of light emitting elements is adjusted to its corresponding maximal value so as to expand the red area of the color gamut of the LCD panel, (ii) when the frame of image data applied to the plurality of pixels is in a green color, the intensity of light in the green color emitting from each of the plurality of light emitting elements is adjusted to its corresponding maximal value so as to expand the green area of the color gamut of the LCD panel, and (iii) when the frame of image data applied to the plurality of pixels is in a blue color, the intensity of light in the blue color emitting from each of the plurality of light emitting elements is adjusted to its corresponding maximal value so as to expand the blue area of the color gamut of the LCD panel.

Furthermore, the signal processing unit 240 is configured such that (i) when the frame of image data applied to the plurality of pixels is in the red color, the intensities of light in the green and blue colors emitting from each of the plurality of light emitting elements are adjusted to their corresponding minimal value, respectively, (ii) when the frame of image data applied to the plurality of pixels is in the green color, the intensities of light in the red and blue colors emitting from each of the plurality of light emitting elements are adjusted to their corresponding minimal value, respectively, and (iii) when the frame of image data applied to the plurality of pixels is in the blue color, the intensities of light in the red and green colors emitting from each of the plurality of light emitting elements are adjusted to their corresponding minimal value, respectively.

In one embodiment, the signal processing unit 240 includes a circuit individually controlling the at least one light emitting element of each of the plurality of regions. In another embodiment, the signal processing unit 240 includes a circuit individually controlling each of the plurality of light emitting elements. In yet another embodiment, the signal processing unit 240 includes a circuit individually controlling each LED of each light emitting element. The intensity of light emitting from each LED of each light emitting element is adjustable between its minimal value and its maximal value discretely and/or continuously.

Figure 4:
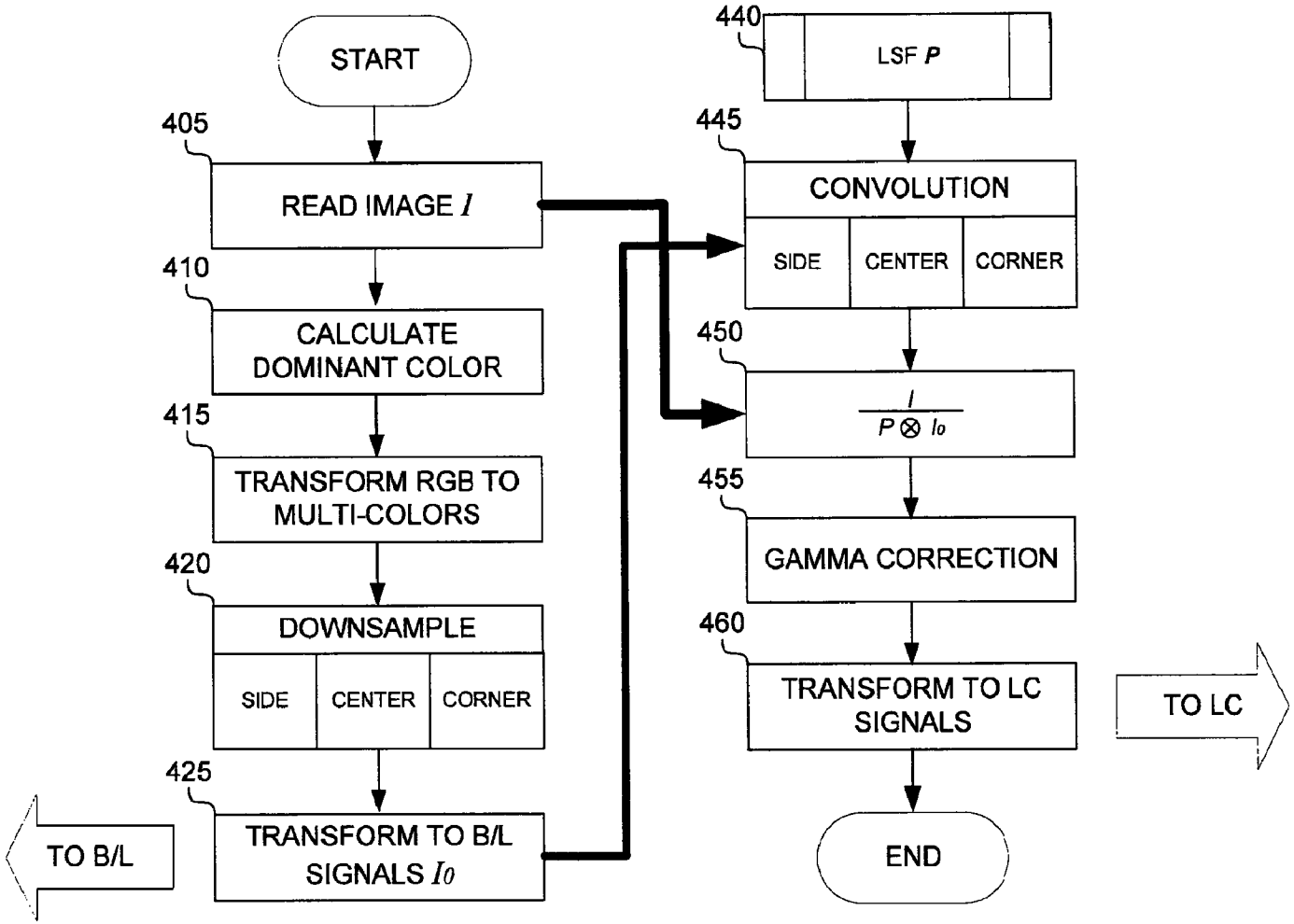
FIG. 4 shows a flow chart of the signal processing of an LCD according to one embodiment of the present invention.

The signal processing procedure for obtaining these two sets of output RGB elements 244, and 246, is illustrated in the flow chart shown in FIG. 4. For the first set of output RGB element 244 for image display on the LCD screen, the signal processing unit 240 performs following functions:

receiving the digital input video signal I from the digital video source 210 as shown in step 405;

calculating the RGB elements of the received digital input video signal to determine a dominant color in each backlight illuminating unit as shown in step 410;

transforming the RGB elements to multi-color video signal, as shown in step 415;

downsampling the multi-color video signal to reduce the resolution of the received digital input video signal such that the resulted signal has a resolution similar to that of the LED backlight panel, as shown in step 420;

converting the downsampled digital input video signal to a backlight signal $I_0$, as shown in step 425;

convoluting the backlight signal $I_0$ from step 425 with a light spread function (hereinafter "LSF") P from step 440, to obtain the set of RGB elements for image display, as shown in step 445;

dividing the original input image I by the convolution results of RGB elements for image display obtained from step 445, as shown in step 450;

applying gamma correction to the set of RGB elements for image display from the result of the division, as shown in step 455;

transforming the set of RGB elements for image display to a set of RGB elements for the LCD screen, as shown in step 460; and presenting the set of RGB elements for image display to the LCD screen 280.

For the second set of output RGB element 246 for backlight of the LCD screen 280, the signal processing unit 240 performs following functions:

receiving the digital input video signal I from the digital video source 210 as shown in step 405;

calculating the RGB elements of the received digital input video signal to determine a dominant color in each backlight illuminating unit as shown in step 410;

transforming the RGB elements to multi-color video signal, as shown in step 415;

downsampling the multi-color video signal to reduce the resolution of the received digital input video signal such that the resulted signal has a resolution similar to that of the LED backlight panel, as shown in step 420;

converting the downsampled digital input video signal to a backlight signal $I_0$, as shown in step 425; and presenting the backlight signal $I_0$ to the LED backlight panel to provide backlight for the LCD screen 280 through a number of backlight illuminating region light source control units, and a number of signal through backlight illuminating unit light source control units.

Figure 5:
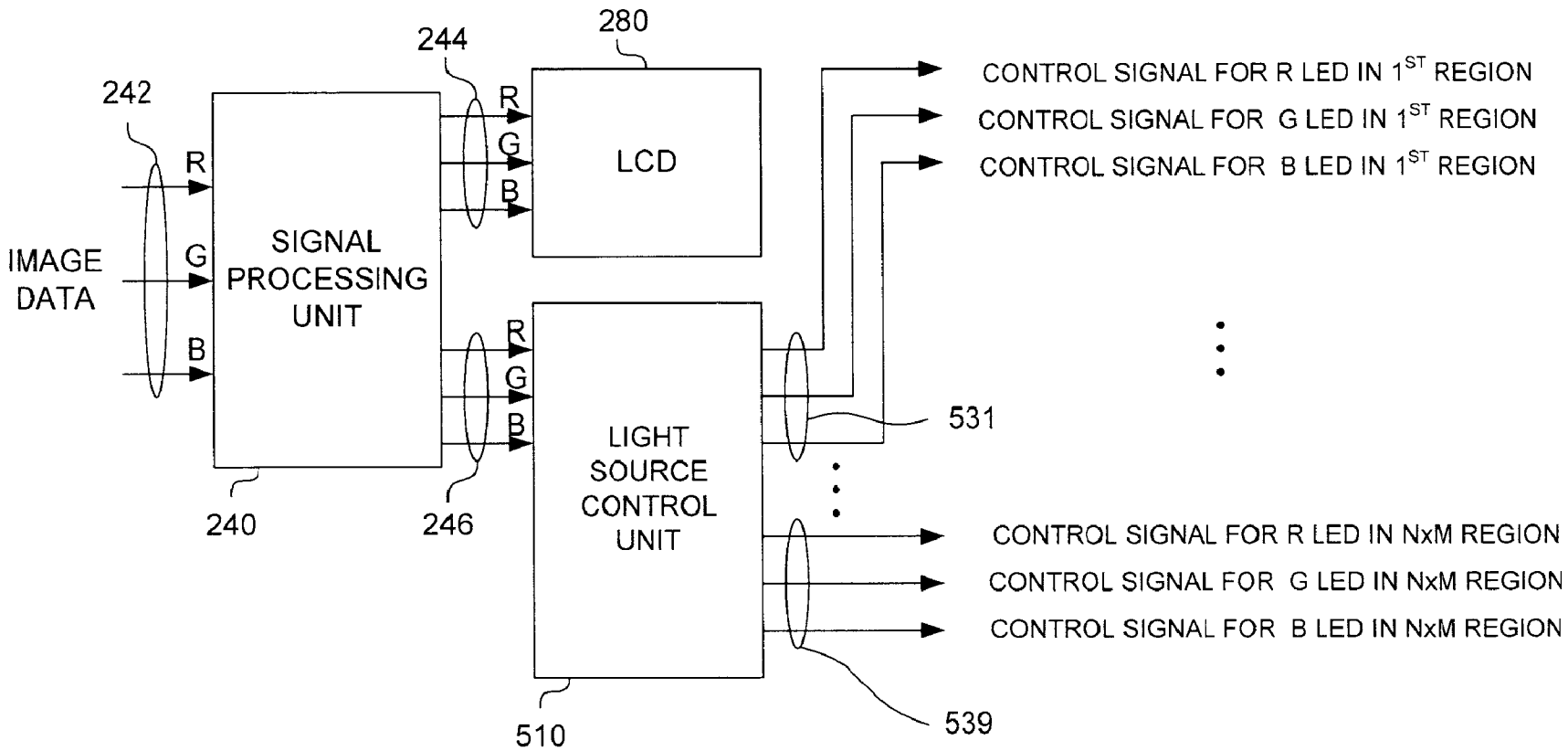
FIG. 5 is a block diagram showing the process of separating image signal into two RGB elements and how a backlight illuminating region light source control unit provides RGB control signals to each LED backlight illuminating region according to one embodiment of the present invention.

Referring now to FIG. 5, a block diagram showing the process of separating image signal into two RGB elements and how a light source control unit provides RGB control signals to each LED backlight illuminating region according to one embodiment of the present invention. The block diagram includes a signal processing unit 240 having a set of input RGB elements 242, a first set of output RGB elements 244 for image display on the LCD screen 280, and a second set of output RGB elements 246 for the backlight of the LCD screen, an LCD screen 280, and a backlight illuminating region light source control unit 510. The second set of output RGB elements 246 for the backlight of the LCD screen is sent to the backlight illuminating region light source control unit 510. The output of the backlight illuminating region light source control unit 510 is N×M sets of three color control signals for red, green and blue color LEDs for N×M backlight illuminating regions. The first set 531 of output signals is for the red LED, the green LED and the blue LED for the first backlight illuminating region. The last set 539 of output signals is for the red LED, the green LED and the blue LED for the (N×M)-th backlight illuminating region.

Figure 6:
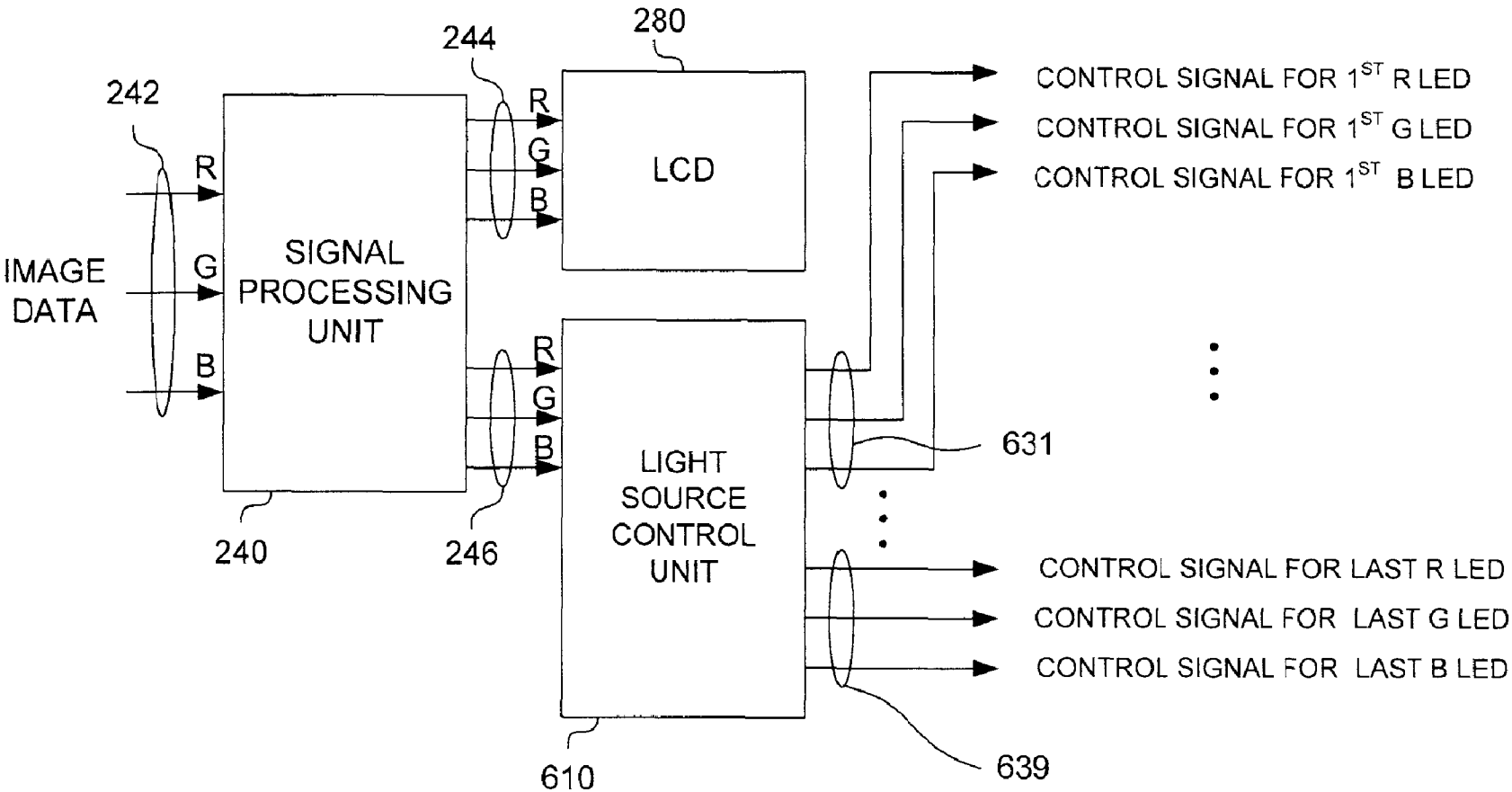
FIG. 6 is a block diagram showing the process of providing individual control signal for each red, green and blue LED of each backlight illuminating unit according to one embodiment of the present invention.

Referring now to FIG. 6, a block diagram shows a process of providing individual control signals for each red, green and blue LED of each backlight illuminating unit according to one embodiment of the present invention. The block diagram includes light source control unit 610.

The light source control unit has a set of three inputs for receiving the red, green and blue control signal. The light source control unit also has P sets of three outputs for providing the red, green and blue control signal for each red, green, and blue LEDs, respectively. The first set 631 of the output signals is to provide control signal to the first red LED, the first green LED, and the first blue LED, respectively. The last set 639 of the output signals is to provide the control signal for the last red LED, the last green LED, and the last blue LED, respectively.

Figure 7:
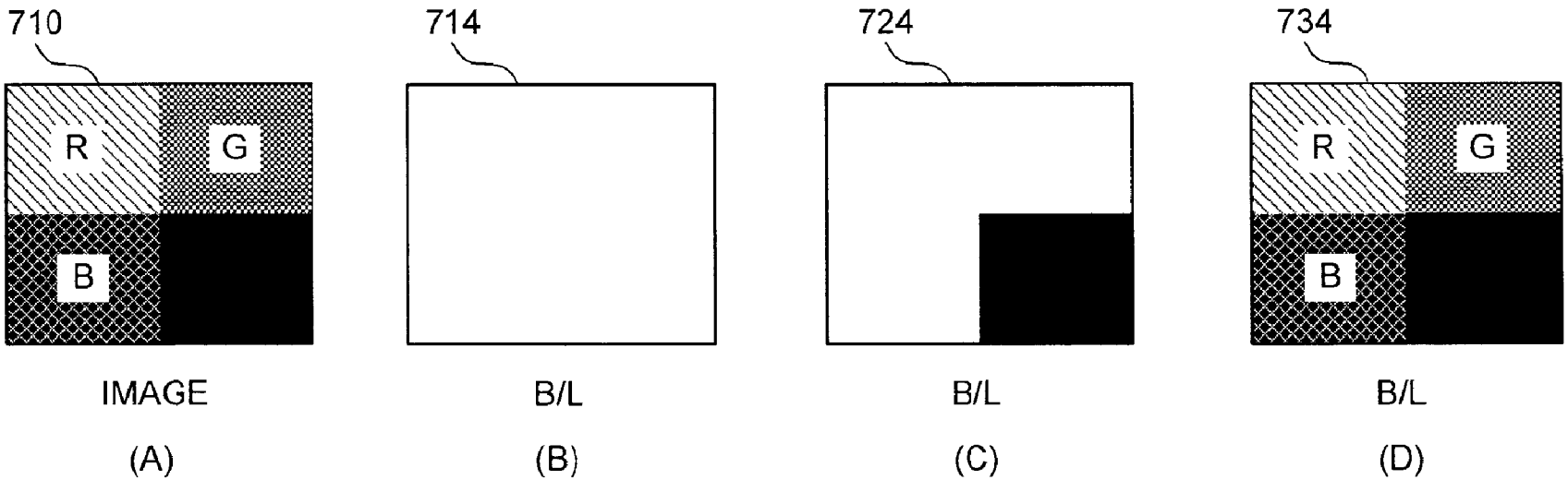
FIG. 7 illustrates how an image is displayed on conventional LCDs, and an LCD according to one embodiment the present invention.
Figure 8:
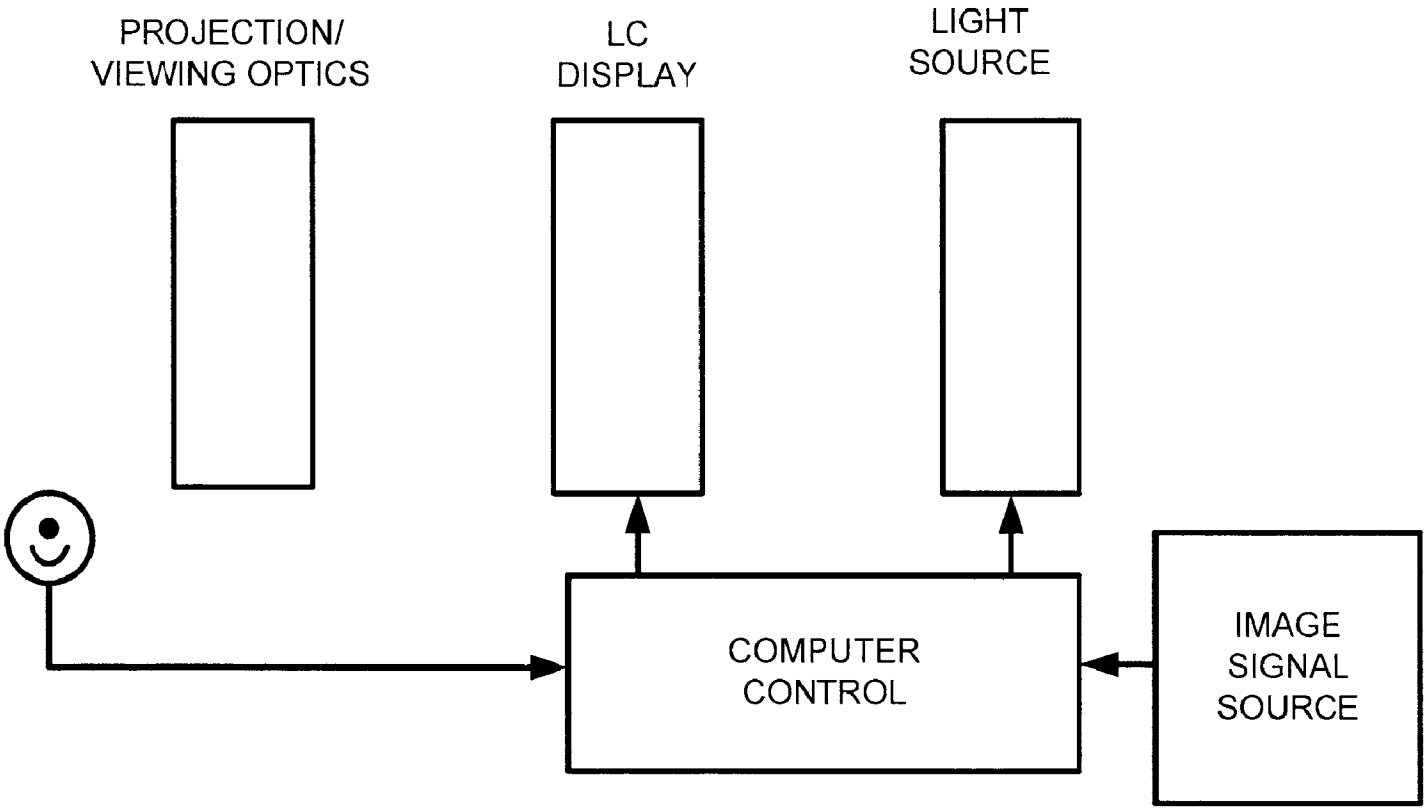
FIG. 8 (RELATED ART)
FIG. 8 shows a block diagram of a conventional optical display system.
Figure 9:
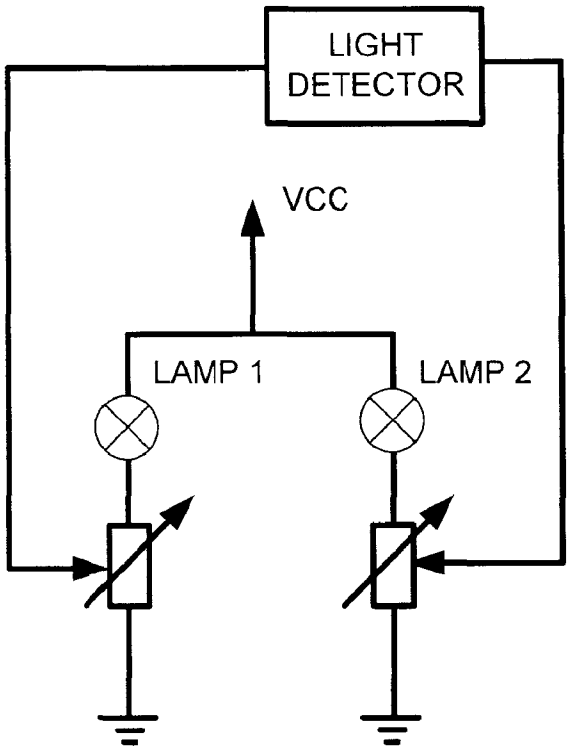
FIG. 9 (RELATED ART)
FIG. 9 shows a block diagram of a conventional back-lit LCD with adjustable color temperature
Figure 9:
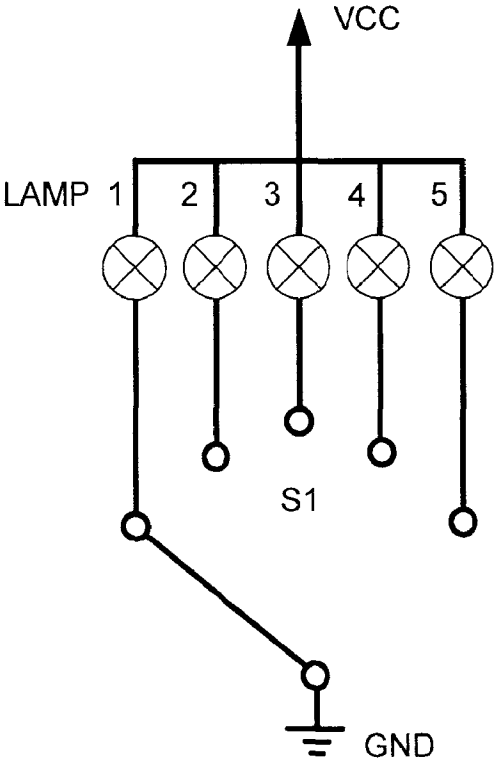
FIG. 9 (RELATED ART)

FIG. 7 illustrates how an image is displayed on conventional LCDs, and an LCD according to one embodiment the present invention. FIG. 9(A) shows an input image 710 to be displayed, which has a red region, a green region, a blue region and a black region. The backlight 714 of a conventional LCD shown in FIG. 7(B) is a white light covering entirely an LCD screen. In response to the input image 710, the conventional backlight 924 is turned off in the black region and turned on in other regions, as shown in FIG. 9(C), which illustrates the backlight control concept of the conventional contrast enhancement method. However, according to the present invention, as shown in FIG. 9(D), the colored backlight 934 based on the color image 710 is provided to the LCD screen such that the portion of the image with a predominately red color has a strong red backlight, the portion of the image with a predominately green color has a strong green backlight, the portion of the image with a predominately blue color has a strong blue backlight, and the backlight is turned off in the black portion of the image 710. Accordingly, the input image 710 is displayed on the LCD screen with maximum color gamut and maximum color depth.

The embodiments of the present invention use color LEDs as backlight source. The color LED backlight source includes at least three different wavelengths. Such color LED backlight source provides much deep colors. The intensities of the red, green and blue color LEDs are controlled by the image to be displayed.

In the image region where the red is dominant color, corresponding red color LED is adjusted to the maximum intensity. The resulting image portion becomes stronger red.

In the image region where the green is dominant color, corresponding green color LED is adjusted to the maximum intensity. The resulting image portion becomes stronger green.

In the image region where the blue is dominant color, corresponding blue color LED is adjusted to the maximum intensity. The resulting image portion becomes stronger blue.

With an increased number of LED, the brightness of the LCD display is further increased. With an increased signal control bits, the number of gray level is also greatly increased, providing increased color contrast, and increased color depth and color saturation. Therefore, the color gamut of the LCD display is maximized. The current passing through each LED is controlled by the input image and they are dynamically adjusted to maximize the color gamut and minimize electrical power consumption.

Another aspect of the present invention relates to a method for dynamically expanding the color gamut of a liquid crystal display (LCD). In one embodiment, the method for dynamically expanding the color gamut of an LCD includes the steps of: (i) providing a backlight unit positioned in relation to the LCD panel, (ii) applying the set of data signals to the plurality of pixels, and (iii) individually controlling the intensities of light of different colors emitting from the source of light in response to the set of data signals applied to the plurality of pixels such that when an area of the LCD panel is applied with a corresponding data signal, the light emitting element associated with the area of the LCD panel emits light with the maximal intensity in a color corresponding to the color associated with the corresponding data signal.

In one embodiment, the backlight includes a source of light capable of emitting light of different colors. The source of light has a plurality of light emitting elements. Each of the plurality of light emitting elements is associated with a corresponding area of the LCD panel having at least one pixel. The emitted light of different colors is characterized with an intensity between a maximal value and a minimal value that is less than the maximal value. In one embodiment, the method further includes the step of directing light emitting from the source of light to the LCD panel.

In one embodiment, each of the plurality of light emitting elements has an LED capable of emitting light in one or more colors. In another embodiment, each of the plurality of light emitting elements has at least three LED chips, each of the at least three LED chips being capable of emitting light in a corresponding color of at least a red color, a green color, and a blue color. The intensity of light emitting from each LED of each light emitting element is adjustable between its minimal value and its maximal value discretely and/or continuously.

Yet another aspect of the present invention relates to a method for dynamically expanding the color gamut of an LCD. The LCD has an LCD panel having a plurality of pixels spatially arranged in a matrix for displaying an image. The image is processed into a set of data signals according to the plurality of pixels of the LCD panel, and each data signal is characterized at least with a color. The method for dynamically expanding the color gamut of an LCD includes the steps of: (i) providing a source of light capable of emitting light of different colors for illuminating the LCD panel responsively, and (ii) individually controlling the intensities of light of different colors emitting from the source of light in response to the set of data signals applied to the plurality of pixels. The emitted light of different colors is characterized with an intensity between a maximal value and a minimal value that is less than the maximal value. In one embodiment, the method further includes the step of applying the set of data signals to the plurality of pixels. In another embodiment, the method further includes the step of directing light emitting from the source of light to the LCD panel.

In one embodiment, the source of light has a plurality of light emitting elements. Each of the plurality of light emitting elements is capable of emitting light in one or more colors and is associated with a corresponding area of the LCD panel having at least one pixel. In one embodiment, the controlling step includes the step of controlling a light emitting element associated with an area of the LCD panel to emit light with the maximal intensity in a color corresponding to the color associated with a corresponding data signal applied to the area of the LCD panel.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A backlight unit usable in a liquid crystal display (LCD) for dynamically expanding the color gamut of the LCD, wherein the LCD has an LCD panel comprising a plurality of pixels spatially arranged in a matrix for displaying an image, comprising:

a. a plurality of light emitting elements, each of the plurality of light emitting elements being capable of emitting light in a red color, a green color and a blue color individually and/or collectively and arranged for illuminating a corresponding area of the LCD panel having at least one pixel, the emitted light in a color characterized with an intensity between a maximal value and a minimal value less than the maximal value; and b. a control unit electrically coupled with the plurality of light emitting elements and configured for controlling the intensity of light emitting from each of the plurality of light emitting elements in response to a frame of image data applied to the plurality of pixels, wherein the control unit is configured such that (i) when the image applied to the plurality of pixels is in a red color, the intensity of light in the red color emitting from each of the plurality of light emitting elements is adjusted to its maximal value, while the intensities of light in the green and blue colors emitting from each of the plurality of light emitting elements are adjusted to their corresponding minimal value, respectively, so as to expand the red area of the color gamut of the LCD panel;

(ii) when the image applied to the plurality of pixels is in a green color, the intensity of light in the green color emitting from each of the plurality of light emitting elements is adjusted to its maximal value, while the intensities of light in the red and blue colors emitting from each of the plurality of light emitting elements are adjusted to their corresponding minimal value, respectively, so as to expand the green area of the color gamut of the LCD panel; and (iii) when the image applied to the plurality of pixels is in a blue color, the intensity of light in the blue color emitting from each of the plurality of light emitting elements is adjusted to its maximal value, while the intensities of light in the red and green colors emitting from each of the plurality of light emitting elements are adjusted to their corresponding minimal value, respectively, so as to expand the blue area of the color gamut of the LCD panel.

2. The backlight unit of claim 1, further comprising a panel for housing the plurality of light emitting elements.

3. The backlight unit of claim 2, wherein the plurality of light emitting elements is spatially arranged in a matrix.

4. The backlight unit of claim 2, wherein the panel is dividable into a plurality of regions.

5. The backlight unit of claim 4, wherein each of the plurality of regions comprises at least one light emitting element.

6. The backlight unit of claim 5, wherein the control unit comprises a circuit controlling the at least one light emitting element individually of each of the plurality of regions.

7. The backlight unit of claim 1, wherein the control unit comprises a circuit controlling each of the plurality of light emitting elements individually.

8. The backlight unit of claim 1, wherein each of the plurality of light emitting elements comprises at least three light emitting diode (LED) chips, each of the at least three LED chips being capable of emitting light in a corresponding color of at least a red color, a green color, and a blue color.

9. The backlight unit of claim 8, wherein the control unit comprises a circuit controlling each LED of each light emitting element individually.

10. The backlight unit of claim 9, wherein the intensity of light emitting from each LED of each light emitting element is adjustable between its minimal value and its maximal value discretely and/or continuously.

11. A backlight unit usable in a liquid crystal display (LCD) for dynamically expanding the color gamut of the LCD, wherein the LCD has an LCD panel comprising a plurality of pixels spatially arranged in a matrix for displaying an image signal and a signal processing unit for processing the image signal into a set of data signals according to the plurality of pixels of the LCD panel, each data signal characterized at least with a color, comprising:

a. a source of light capable of emitting light of different colors, the source of light comprising a plurality of light emitting elements, each of the plurality of light emitting elements arranged for illuminating a corresponding area of the LCD panel having at least one pixel, the emitted light of different colors characterized with an intensity between a maximal value and a minimal value less than the maximal value; and b. a control unit electrically coupled with the source of light and configured for individually controlling the intensities of light of different colors emitting from the source of light in response to the set of data signals applied to the plurality of pixels such that when an area of the LCD panel is applied with a corresponding data signal, the light emitting element associated with the area of the LCD panel emits light with the maximal intensity in a color corresponding to the color associated with the corresponding data signal and with the minimal intensities in the other colors.

12. The backlight unit of claim 11, further comprising a panel for housing the plurality of light emitting elements.

13. The backlight unit of claim 12, wherein the plurality of light emitting elements is spatially arranged in a matrix.

14. The backlight unit of claim 12, wherein the panel is dividable into a plurality of regions.

15. The backlight unit of claim 14, wherein each of the plurality of regions comprises at least one light emitting element.

16. The backlight unit of claim 15, wherein the control unit comprises a circuit controlling the at least one light emitting element individually of each of the plurality of regions.

17. The backlight unit of claim 11, wherein the control unit comprises a circuit controlling each of the plurality of light emitting elements individually.

18. The backlight unit of claim 11, wherein each of the plurality of light emitting elements comprises a light emitting diode (LED) capable of emitting light in one or more colors.

19. The backlight unit of claim 11, wherein each of the plurality of light emitting elements comprises at least three light emitting diode (LED) chips, each of the at least three LED chips being capable of emitting light in a corresponding color of at least a red color, a green color, and a blue color.

20. The backlight unit of claim 19, wherein the control unit comprises a circuit controlling each LED of each light emitting element individually.

21. The backlight unit of claim 20, wherein the intensity of light emitting from each LED of each light emitting element is adjustable between its minimal value and its maximal value discretely and/or continuously.

22. The backlight unit of claim 11, wherein the signal processing unit is configured to perform the functions of:

a. receiving the image signal I from a video source;

b. calculating RGB elements of the image signal I to determine a dominant color in each backlight illuminating area;

c. transforming the RGB elements into a multi-color video signal;

d. downsampling the multi-color video signal to form a downsampled image signal that has a resolution corresponding to that of the backlight unit;

e. converting the downsampled image signal into a backlight signal $I_0$; and f. presenting the backlight signal $I_0$ to the control unit of the backlight unit.

23. The method of claim 22, wherein the signal processing unit is configured to further perform the functions of:

a. convoluting the backlight signal $I_0$ from with a light spread function (LSF) P to form a convoluted signal P $\otimes$ I;

b. dividing the image signal I by the convoluted signal P $\otimes$ I to obtain the set of RGB elements;

c. applying gamma correction to the set of RGB elements; and d. transforming the set of RGB elements to a set of data signal for image display in the LCD panel.

24. A method for dynamically expanding the color gamut of a liquid crystal display (LCD), wherein the LCD has an LCD panel comprising a plurality of pixels spatially arranged in a matrix for displaying an image, and wherein the image is processed into a set of data signals according to the plurality of pixels of the LCD panel, each data signal characterized at least with a color, comprising the steps of:

a. providing a backlight unit positioned in relation to the LCD panel, the backlight unit comprising a source of light capable of emitting light of different colors, the source of light comprising a plurality of light emitting elements, each of the plurality of light emitting elements associated with a corresponding area of the LCD panel having at least one pixel, the emitted light of different colors characterized with an intensity between a maximal value and a minimal value less than the maximal value;

b. applying the set of data signals to the plurality of pixels; and c. individually controlling the intensities of light of different colors emitting from the source of light in response to the set of data signals applied to the plurality of pixels such that when an area of the LCD panel is applied with a corresponding data signal, the light emitting element associated with the area of the LCD panel emits light with the maximal intensity in a color corresponding to the color associated with the corresponding data signal and with the minimal intensities in the other colors.

25. The method of claim 24, further comprising the step of directing light emitting from the source of light to the LCD panel.

26. The method of claim 24, wherein each of the plurality of light emitting elements comprises a light emitting diode (LED) capable of emitting light in one or more colors.

27. The method of claim 24, wherein each of the plurality of light emitting elements comprises at least three light emitting diode (LED) chips, each of the at least three LED chips being capable of emitting light in a corresponding color of at least a red color, a green color, and a blue color.

28. The method of claim 24, wherein the intensity of light emitting from each LED of each light emitting element is adjustable between its minimal value and its maximal value discretely and/or continuously.

29. A method for dynamically expanding the color gamut of a liquid crystal display (LCD), wherein the LCD has an LCD panel comprising a plurality of pixels spatially arranged in a matrix for displaying an image, and wherein the image is processed into a set of data signals according to the plurality of pixels of the LCD panel, each data signal characterized at least with a color, comprising the steps of:

a. providing a source of light capable of emitting light of different colors for illuminating the LCD panel responsively, the emitted light of different colors characterized with an intensity between a maximal value and a minimal value less than the maximal value; and b. individually controlling the intensities of light of different colors emitting from the source of light in response to the set of data signals applied to the plurality of pixels such that when an area of the LCD panel is applied with a corresponding data signal, the light emitting element associated with the area of the LCD panel emits light with the maximal intensity in a color corresponding to the color associated with the corresponding data signal and with the minimal intensities in the other colors.

30. The method of claim 29, further comprising the step of applying the set of data signals to the plurality of pixels.

31. The method of claim 30, further comprising the step of directing light emitting from the source of light to the LCD panel.

32. The method of claim 29, wherein the source of light comprises a plurality of light emitting elements, each of the plurality of light emitting elements capable of emitting light in one or more colors and associated with a corresponding area of the LCD panel having at least one pixel.

33. The method of claim 32, wherein the controlling step comprises the step of controlling a light emitting element associated with an area of the LCD panel to emit light with the maximal intensity in a color corresponding to the color associated with a corresponding data signal applied to the area of the LCD panel.

34. The method of claim 32, wherein each of the plurality of light emitting elements comprises a light emitting diode (LED) capable of emitting light in one or more colors.

35. The method of claim 32, wherein each of the plurality of light emitting elements comprises at least three light emitting diode (LED) chips, each of the at least three LED chips being capable of emitting light in a corresponding color of at least a red color, a green color, and a blue color.

* * * * *